US011705103B2

(12) United States Patent
McCutcheon et al.

(10) Patent No.: US 11,705,103 B2
(45) Date of Patent: Jul. 18, 2023

(54) AUDIO SYSTEM AND SIGNAL PROCESSING METHOD OF VOICE ACTIVITY DETECTION FOR AN EAR MOUNTABLE PLAYBACK DEVICE

(71) Applicant: ams AG, Premstätten (AT)

(72) Inventors: Peter McCutcheon, Premstätten (AT); Dylan Morgan, Premstätten (AT)

(73) Assignee: AMS AG, Premstätten (AT)

( * ) Notice: Subject to any disclaimer, the term of this patent is extended or adjusted under 35 U.S.C. 154(b) by 130 days.

(21) Appl. No.: 17/440,984

(22) PCT Filed: Mar. 17, 2020

(86) PCT No.: PCT/EP2020/057286
§ 371 (c)(1),
(2) Date: Sep. 20, 2021

(87) PCT Pub. No.: WO2020/193286
PCT Pub. Date: Oct. 1, 2020

(65) Prior Publication Data

US 2022/0165245 A1 May 26, 2022

(30) Foreign Application Priority Data

Mar. 22, 2019 (EP) ..... 19164680
Jul. 18, 2019 (EP) ..... 19187045

(51) Int. Cl.
*G10K 11/178* (2006.01)
*G10L 25/78* (2013.01)

(52) U.S. Cl.
CPC .... *G10K 11/1783* (2018.01); *G10K 11/17823* (2018.01); *G10K 11/17825* (2018.01);
(Continued)

(58) Field of Classification Search
CPC ..... H04R 1/1083; G10K 2210/1081; G10L 25/78
See application file for complete search history.

(56) References Cited

U.S. PATENT DOCUMENTS 4,494,074 A 1/1985 Bose
5,138,664 A 8/1992 Kimura et al.
(Continued)

OTHER PUBLICATIONS

Ben Jebara, S., "A Voice Activity Detector In Noisy Environments Using Linear prediction And Coherence Method", Proc. WSES Multiconference on Acoustics Music: Theory and Applications, 2001, pp. 308-311.

(Continued)

*Primary Examiner* — Ping Lee
(74) *Attorney, Agent, or Firm* — MH2 Technology Law Group LLP

(57) ABSTRACT

An audio system for an ear mountable playback device comprises a speaker, an error microphone predominantly sensing sound being output from the speaker and a feed-forward microphone predominantly sensing ambient sound. The audio system further comprises a voice activity detector which is configured to record a feed-forward signal from the feed-forward microphone. Furthermore, an error signal is recorded from the error microphone. A detection parameter is determined as a function of the feed-forward signal and the error signal. The detection parameter is monitored and a voice activity state is set depending on the detection parameter.

9 Claims, 8 Drawing Sheets

(52) U.S. Cl.
CPC .. *G10K 11/17854* (2018.01); *G10K 11/17881* (2018.01); *G10L 25/78* (2013.01); *G10K 2210/1081* (2013.01); *G10K 2210/3026* (2013.01); *G10K 2210/3027* (2013.01); *G10K 2210/3028* (2013.01); *G10K 2210/3044* (2013.01); *G10L 2025/783* (2013.01)

(56) References Cited

U.S. PATENT DOCUMENTS

| | | | | |
|---|---|---|---|---|
| 2002/0165718 | A1 | 11/2002 | Graumann et al. | |
| 2008/0095384 | A1 | 4/2008 | Son et al. | |
| 2010/0266137 | A1 | 10/2010 | Sibbald et al. | |
| 2011/0293103 | A1 | 12/2011 | Park et al. | |
| 2015/0106087 | A1 | 4/2015 | Newman | |
| 2016/0241948 | A1* | 8/2016 | Liu | H04R 3/005 |
| 2017/0148428 | A1 | 5/2017 | Thuy et al. | |
| 2019/0215619 | A1 | 7/2019 | Merks | |
| 2020/0304903 | A1* | 9/2020 | Kim | H04R 1/1083 |

OTHER PUBLICATIONS

Benyassine et al., "ITU-T Recommendation G. 729 Annex B: A Silence Compression Scheme for Use with G.729 Dptimized for V. 70 Digital Simultaneous Voice and Data Applications", IEEE Community Magazine, 1997, pp. 64-72.

Elliot, S., "Signal Processing for Active Control", Academic Press, 2001, 23 pages.

Reinfeldt et al., "Hearing one's own voice during phoneme vocalization—Transmission by air and bone conduction", The Journal of the Acoustical Society of America, 2010, vol. 128, No. 751, pp. 751-762.

Breccia, Luca (EP Examiner), International Search Report and Written Opinion in corresponding International Application No. PCT/EP2020/057286 dated Jun. 4, 2020, 26 pages.

* cited by examiner

AUDIO SYSTEM AND SIGNAL PROCESSING METHOD OF VOICE ACTIVITY DETECTION FOR AN EAR MOUNTABLE PLAYBACK DEVICE

CROSS-REFERENCE TO RELATED APPLICATIONS

The present application is the national stage entry of International Patent Application No. PCT/EP2020/057286, filed on Mar. 17, 2020, and published as WO 2020/193286 A1 on Oct. 1, 2020, which claims the benefit of priority of European Patent Application Nos. 19164680.1, filed on Mar. 22, 2019, and 19187045.0, filed on Jul. 18, 2019, all of which are incorporated by reference herein in their entirety.

The present disclosure relates to an audio system and to a signal processing method of voice activity detection for an ear mountable playback device, e.g. a headphone, comprising a speaker, an error microphone and a feed-forward microphone.

Today an increasing number of headphones or earphones are equipped with noise cancellation techniques. For example, such noise cancellation techniques are referred to as active noise cancellation or ambient noise cancellation, both abbreviated with ANC. ANC generally makes use of recording ambient noise that is processed for generating an anti-noise signal, which is then combined with a useful audio signal to be played over a speaker of the headphone. ANC can also be employed in other audio devices like handsets or mobile phones. Various ANC approaches make use of feedback, FB, or error, microphones, feed-forward, FF, microphones or a combination of feedback and feed-forward microphones. FF and FB ANC is achieved by tuning a filter based on given acoustics of an audio system.

Hybrid noise cancellation headphones are generally known. For instance, a microphone is placed inside a volume that is directly coupled to the ear drum, conventionally close to the front of the headphones driver. This is referred to as the feedback, FB, microphone or error microphone. A second microphone, the feed-forward, FF, microphone, is placed on the outside of the headphone, such that it is acoustically decoupled from the headphones driver.

A conventional ambient noise cancelling headphone features a driver with an air volume in front and behind it. The front volume is made up in part by the ear canal volume of a user wearing the headphone. The front volume usually consists of a vent which is covered with an acoustic resistor. The rear volume also typically features a vent with an acoustic resistor. Often the front volume vent acoustically couples the front and rear volumes. There are two microphones per left and right channel. The error, or feedback, FB, microphone is placed in close proximity to the driver such that it detects sound from the driver and sound from the ambient environment. The feed-forward, FF, microphone is placed facing out from the rear of the unit such that it detects ambient sound, and negligible sound from the driver.

With this arrangement, two forms of noise cancellation can take place, feed-forward, FF, and feedback, FB. Both systems involve a filter placed in-between the microphone and the driver. The feed-forward system detects the noise outside the headphone, processes it via the filter and outputs an anti-noise signal from the driver, such that a superposition of the anti-noise signal and the noise signal occurs at the ear to produce noise cancellation. The signal path is as follows:

$$ERR = AE - AM \cdot F \cdot DE$$

where ERR is the residual noise at the ear, AE is the ambient to ear acoustic transfer function, AM is the ambient to FF microphone acoustic transfer function, F is the FF filter and DE is the driver to ear acoustic transfer function. All signals are complex, in the frequency domain, thus containing an amplitude and a phase component. Therefore it follows that for perfect noise cancellation, ERR tends to zero:

$$F = \frac{AE}{AM.DE}$$

In practice, however, the acoustic transfer functions can change depending on the headphones fit. For leaky earphones, there may be a highly variable leak acoustically coupling the front volume to the ambient environment, and transfer functions AE and DE may change substantially, such that it is necessary to adapt the FF filter in response to the acoustic signals in the ear canal to minimize the error. Unfortunately, when a headphone user is speaking, the signals at the microphones become mixed with bone conducted voice signals and can cause errors and false nulls in the adaption process.

It is an objective to provide an audio system and a signal processing method of voice activity detection which allow for improving voice activity detection, e.g. detection of voice being present of the ear canal of a user of the audio system.

These objectives are achieved by the subject matter of the independent claims. Further developments and embodiments are described in dependent claims.

It is to be understood that any feature described in relation to any one embodiment may be used alone, or in combination with other features described herein, and may also be used in combination with one or more features of any other of the embodiments, or any combination of any other of the embodiments unless described as an alternative. Furthermore, equivalents and modifications not described below may also be employed without departing from the scope of the audio system and the method of voice activity detection which are defined in the accompanying claims.

The following relates to an improved concept in the field of ambient noise cancellation. The improved concept allows for implementing a voice activity detection, e.g. in playback devices such as headphones that need a first person voice activity detector which could be necessary for adaptive ANC processes, acoustic on-off ear detection and voice commands. The improved concept may be applied to adaptive ANC for leaky earphones. The term "adaptive" will refer to adapting the anti-noise signal according to leakage acoustically coupling the device's front volume to the ambient environment. A voice activity detector that uses the relationship between two microphones to detect the user's voice and not a third person's voice, and that uses the relationship between two microphones to detect user voice in a headphone scenario. The improved concept also looks at simple parameters to keep processing to a minimum.

The improved concept may not detect third person voice, which means in the context of an adaptive ANC headphone that adaption only stops when the user, i.e. the first person, talks and not a third party, maximizing adaption bandwidth. It may only detect bone conducted voice.

The improved concept can be implemented with simple algorithms which ultimately means it can run at lower power (on a lower spec. device) than some algorithms.

The improved concept does not rely on detecting ambient sound periods in between voice as a reference (like the coherence method, for example). Its reference is essentially the known phase relationship between the microphones. Therefore it can quickly decide if there is voice or not.

In at least one embodiment an audio system for an ear mountable playback device comprises a speaker, an error microphone which predominantly senses sound being output from the speaker and a feed-forward microphone which predominantly senses ambient sound. The audio system further comprises a voice activity detector which is configured to perform the following steps, including recording a feed-forward signal from the feed-forward microphone and recording an error signal from the error microphone. A detection parameter is determined as a function of the feed-forward signal and the error signal. The detection parameter is monitored and a voice activity state is set depending on the detection parameter.

In at least one embodiment the detection parameter is based on a ratio of the feed-forward signal and the error signal.

In at least one embodiment the detection parameter is further based on a sound signal.

In at least one embodiment the detection parameter is an amplitude difference between the feed-forward signal and the error signal. The detection parameter may be indicative of an ANC performance, e.g. ANC performance is determined from the ratio of amplitudes between the microphones.

In at least one embodiment, the detection parameter is a phase difference between the error signal and the feed-forward signal.

In at least one embodiment the audio system further comprises an adaptive noise cancellation controller which is coupled to the feed-forward microphone and to the error microphone. The adaptive noise cancellation controller is configured to perform noise cancellation processing depending on the feed-forward signal and/or the error signal. A filter is coupled to the feed-forward microphone and to the speaker, and has a filter transfer function determined by the noise cancellation processing.

In at least one embodiment the noise cancellation processing includes feed-forward, or feed-backward, or both feed-forward and feed-backward noise cancellation processing.

In at least one embodiment the detection parameter is indicative of a performance of the noise cancellation processing.

In at least one embodiment a voice activity detector process determines one of the following voice activity states: false, true, or likely. The detection state equals "true" indicates voice detected. The detection state equals "false" indicates voice not detected. The detection state equals "likely" indicates that voice is likely.

In at least one embodiment the voice activity detector controls the adaptive noise cancellation controller depending on the voice activity state.

In at least one embodiment the control of the adaptive noise cancellation controller comprises terminating the adaption of a noise cancelling signal of the noise cancellation processing in case the voice activity state is set to "true" and/or "likely". The adaption of the noise cancelling signal is continued in case the voice activity state is set to "false".

In at least one embodiment the voice activity detector, in a first mode of operation, analyses a phase difference between the feed-forward signal and the error signal. The voice activity state is set depending on the analyzed phase difference.

In at least one embodiment the first mode of operation is entered when the detection parameter is larger than, or exceeds, a first threshold. This is to say that, in general, a difference between the detection parameter and the first threshold is considered. Hereinafter the term "exceed" is considered equivalent to "larger than" or "greater than".

In at least one embodiment the phase difference is monitored in the frequency domain. The phase difference is analyzed in terms of an expected transfer function, such that deviations from the expected transfer function, at least at some frequencies, are recorded. The voice activity state is set depending on the recorded deviations.

In at least one embodiment voice is detected by identifying peaks in phase difference in the frequency domain.

In at least one embodiment the analyzed phase difference is compared to an expected phase difference. The voice activity state is set to "false" when the analyzed phase difference is smaller than the expected phase difference and else set to "true". This is to say that, in general, a difference between the analyzed phase difference and the expected phase difference is considered and should not exceed a predetermined value, or range of values.

In at least one embodiment the voice activity detector, in a second mode of operation, analyzes a level of tonality of the error signal and sets the voice activity state depending on the analyzed level of tonality.

In at least one embodiment the second mode of operation is entered when the detection parameter is smaller than a first threshold In at least one embodiment the analyzed level of tonality is compared to an expected level of tonality. The voice activity state is set to "true" when the analyzed level of tonality exceeds the expected level of tonality, and else set to "false". This is to say that, in general, a difference between the analyzed level of tonality and the expected level of tonality is considered and should not exceed a predetermined value, or range of values.

In at least one embodiment the voice activity detector, in a third mode of operation, monitors the detection parameter for a first period of time, denoted short term parameter, and for a second period of time, denoted long term parameter. The first period is shorter in time than the second period. Furthermore, the voice activity detector combines the short term parameter and the long term parameter to yield a combined detection parameter, and sets the voice activity state depending on the combined detection parameter. In at least one embodiment the third mode may run independently of the first two modes.

In at least one embodiment the short term parameter and long term parameter are equivalent to energy levels. The voice activity state is set to "likely" when a change in relative energy levels exceeds a second threshold.

In at least one embodiment, in a fourth mode of operation the voice activity detector determines whether or not a wanted sound signal is active. If no sound signal is active the voice activity detector enters the first or second mode of operation. If the sound signal is active, the voice activity detector enters the second mode operation if the first threshold exceeds the analyzed detection parameter, or if the sound signal is active, and if the analyzed detection parameter exceeds the first threshold, enters a combined first and second mode of operation. In other words, if music is present the voice activity detector may either enter the second mode of operation, or a combined mode of operation based on the detection parameter, e.g. ANC approximation.

In at least one embodiment the voice activity detector, in the combined first and second mode of operation, analyses a level of tonality of the error signal and analyses a phase difference between the feed-forward signal and the error signal. Furthermore, the voice activity detector sets the voice activity state depending on both the analyzed phase difference and analyzed level of tonality.

In at least one embodiment, in the combined first and second mode of operation, the analyzed level of tonality is compared to the expected level of tonality and the analyzed phase difference is compared to the expected phase difference. The voice activity state is set to "true" when both the analyzed level of tonality exceeds the expected level of tonality and, further, the analyzed phase difference exceeds the expected phase difference. The voice activity state is set to "false" when either the expected level of tonality exceeds the analyzed level of tonality and, further, the expected phase difference exceeds the analyzed phase difference.

In at least one embodiment the audio system includes the ear mountable playback device.

In at least one embodiment the adaptive noise cancellation controller, the voice activity detector and/or the filter are included in a housing of the playback device.

In at least one embodiment the playback device is a headphone or an earphone.

In at least one embodiment the headphone or earphone is designed to be worn with a predefined acoustic leakage between a body of the headphone or earphone and a head of a user.

In at least one embodiment the playback device is a mobile phone.

In at least one embodiment the adaptive noise cancellation controller, the voice activity detector and/or the filter are integrated into a common device.

In at least one embodiment, if the playback device is worn in the ear of the user, the device has a front-volume and a rear-volume either side of the driver, wherein the front-volume comprises, at least in part, the ear canal of the user. The error microphone is arranged in the playback device such that the error microphone is acoustically coupled to the front-volume. The feed-forward microphone is arranged in the playback device such that it faces out from the rear-volume.

In at least one embodiment the playback device comprises a front vent with or without a first acoustic resistor that couples the front-volume to the ambient environment. In addition, or alternatively, a rear vent with or without a second acoustic resistor couples the rear-volume to the ambient environment.

In at least one embodiment the playback device comprises a vent that couples the front-volume to the rear-volume.

A signal processing method of voice activity detection can be applied to an ear mountable playback device comprising a speaker, an error microphone sensing sound being output from the speaker and ambient sound and a feed-forward microphone predominantly sensing ambient sound. The method maybe executed by means of a voice activity detector. In at least one embodiment the method comprising the steps of recording a feed-forward signal from the feed-forward microphone and recording an error signal from the error microphone. A detection parameter is determined as a function of the feed-forward signal and the error signal. The detection parameter is monitored and a voice activity state is set depending on the detection parameter.

Further implementations of the method are readily derived from the various implementations and embodiments of the audio system and vice versa.

In all of the embodiments described above, ANC can be performed both with digital and/or analog filters. All of the audio systems may include feedback ANC as well. Processing and recording of the various signals is preferably performed in the digital domain.

According to one aspect a noise cancelling ear worn device comprising a driver with a volume in front of and behind it such that the front volume is made up of at least in part the ear canal, and an error microphone acoustically coupled to the front volume which detects ambient noise and the driver signal, a feed-forward (FF) microphone facing out from the rear volume which detects ambient noise and only a negligible portion of the driver signal, whereby the feed-forward FF microphone is coupled to the driver via a filter resulting in the driver outputting a signal that at least in part cancels the noise at the error microphone, and includes a processor that monitors the phase difference between the two microphones which triggers a voice active stage state depending on the condition of this phase difference.

According to another aspect a device as described above monitors the phase difference in the frequency domain and deviations from an expected transfer function at some frequencies and not others dictates that voice has occurred.

According to another aspect a time domain process runs to flag a possible voice detected case which can act faster than the frequency domain process.

According to another aspect a second process is run to detect tonality in the ambient signal.

According to another aspect the second process is run in the frequency domain.

According to an aspect an audio system for an ear mountable playback device (HP) comprises:

- a speaker (SP),
- an error microphone (FB_MIC) sensing sound being output from the speaker and ambient sound (SP) and
- a feed-forward microphone (FF_MIC) predominantly sensing ambient sound, wherein the audio system comprises a voice activity detector VAD) configured to:

- recording a feed-forward signal (FF) from the feed-forward microphone (FF_MIC),
- recording an error signal (ERR) from the error microphone (FB_MIC),
- determining at least one detection parameter as a function of the feed-forward signal (FF) and the error signal (ERR), and
- monitoring the at least one detection parameter and setting a voice activity state depending on the at least one detection parameter.

According to an aspect the detection parameter is based on a ratio of the feed-forward signal (FF) and the error signal (ERR).

According to an aspect the detection parameter is a phase difference between the error signal and the feed-forward signal.

According to an aspect the detection parameter is further based on a sound signal (MUS).

According to an aspect the voice activity detector (VAD) configured to remove the sound signal (MUS) from the error signal (ERR).

According to an aspect the detection parameter is a phase difference between the feed-forward signal (FF) and the error signal (ERR).

According to an aspect the audio system further comprises:

an adaptive noise cancellation controller (ANCC) coupled to the feed-forward microphone (FF_MIC) and to the error microphone (FB_MIC), the adaptive noise cancellation controller (ANCC) being configured to perform noise cancellation processing depending on the feed-forward signal (FF) and/or the error signal (ERR), and a filter (FL) coupled to the feed-forward microphone (FF_MIC) and to the speaker (SP), having a filter transfer function (F) determined by the noise cancellation processing.

According to an aspect the noise cancellation processing includes feed-forward, or feed-backward, or both feed-forward and feed-backward noise cancellation processing.

According to an aspect the detection parameter is indicative of a performance of the noise cancellation processing.

According to an aspect:

a voice activity detector process determines one of the following voice activity states: false, true, or likely, the voice activity state equals true indicates voice detected, and the voice activity state equals false indicates voice likely detected.

According to an aspect the voice activity detector (VAD) controls the adaptive noise cancellation controller (ANCC) depending on the voice activity state.

According to an aspect the control of the adaptive noise cancellation controller (ANCC) comprises:

terminating the adaption of a noise cancelling signal in case the voice activity state is set to true and/or likely, and continuing the adaption of a noise cancelling signal in case the voice activity state is set to false.

According to an aspect the voice activity detector (VAD), in a first mode of operation:

analyses a phase difference between the feed-forward signal (FF) and the error signal (ERR) and sets the voice activity state depending on the analyzed phase difference.

According to an aspect the first mode of operation is entered when the detection parameter is larger than a first threshold.

According to an aspect:

the phase difference is monitored in the frequency domain, the phase difference is analyzed in terms of an expected transfer function, such that deviations from the expected transfer function, at least at some frequencies, are recorded, and the voice activity state is set depending on the recorded deviations.

According to an aspect voice is detected by identifying peaks in the frequency domain phase response.

According to an aspect:

the analyzed phase difference is compared to an expected phase difference, and the voice activity state is set to false when the analyzed phase difference is smaller than the expected phase difference and set to true else.

According to an aspect the voice activity detector (VAD), in a second mode of operation:

analyzes a level of tonality of the error signal (ERR) and sets the voice activity state depending on the analyzed level of tonality.

According to an aspect the second mode of operation is entered when the first threshold is smaller than the detection parameter.

According to an aspect:

the analyzed level of tonality is compared to an expected level of tonality, the voice activity state is set to true when the analyzed level of tonality exceeds the expected level of tonality, and else set to false.

According to an aspect the voice activity detector (VAD), in a third mode of operation:

monitors the detection parameter for a first period of time, denoted short term parameter, and for a second period of time, denoted long term parameter, wherein the first period is shorter in time than the second period, combines the short parameter and the long term parameter to yield a combined detection parameter, and sets the voice activity state depending on the combined detection parameter.

According to an aspect in the third mode of operation:

the short term parameter and long term parameter are equivalent to energy levels, and voice activity state is set to likely when a change in relative energy levels exceeds a second threshold.

According to an aspect the voice activity detector (VAD), in a fourth mode of operation:

determines whether or not the sound signal (MUS) is active, if no sound signal (MUS) is active enters the first or second mode of operation, if the sound signal (MUS) is active, enters the second mode operation if when the detection parameter is smaller than the first threshold, or if the sound signal (MUS) is active, and if the analyzed phase difference exceeds the first threshold, enters a combined first and second mode of operation.

According to an aspect the voice activity detector (VAD), in the combined first and second mode of operation:

analyses a level of tonality of the error signal (ERR) and analyses a phase difference between the feed-forward signal (FF) and the error signal (ERR) and sets the voice activity state depending on both the analyzed phase difference and analyzed level of tonality.

According to an aspect in the combined first and second mode of operation:

the analyzed level of tonality is compared to the expected level of tonality and the analyzed phase difference is compared to the expected phase difference, the voice activity state is set to false when the analyzed level of tonality is smaller than the expected level of tonality and, further, the analyzed phase difference is smaller than the expected phase difference, and the voice activity state is set to true when the analyzed level of tonality exceeds the expected level of tonality and, further, the analyzed phase difference exceeds the expected phase difference.

According to an aspect the audio system includes the ear mountable playback device.

According to an aspect the adaptive noise cancellation controller (ANCC), the voice activity detector (VAD) and/or the filter (FL) are included in a housing of the playback device.

According to an aspect the playback device is a headphone or an earphone.

According to an aspect the headphone or earphone is designed to be worn with a predefined acoustic leakage between a body of the headphone or earphone and a head of a user.

According to an aspect the playback device is a mobile phone.

According to an aspect the adaptive noise cancellation controller (ANCC), the voice activity detector (VAD) and/or the filter (FL) are integrated into a common driver (DRV).

According to an aspect, if the playback device is worn in the ear of the user, the device, has a front-volume and a rear-volume, wherein the front-volume comprises, at least in part, the ear canal of the user, the error microphone is arranged in the playback device such that the error microphone is acoustically coupled to the front-volume, and the feed-forward (FF) microphone is arranged in the playback device such that it faces out from the rear-volume.

According to an aspect the playback device comprises a front vent with or without a first acoustic resistor that couples the front-volume to the ambient environment, and/or a rear vent with or without a second acoustic resistor that couples the rear-volume to the ambient environment.

According to an aspect the playback device comprises a vent that couples the front-volume to the rear-volume.

According to an aspect a signal processing method of voice activity detection for an ear mountable playback device (HP) comprising a speaker (SP), an error microphone (FB_MIC) predominantly sensing sound being output from the speaker (SP) and a feed-forward microphone (FF_MIC) predominantly sensing ambient sound, comprises the steps of:

recording a feed-forward signal (FF) from the feed-forward microphone (FF_MIC), recording an error signal (ERR) from the error microphone (FB_MIC), determining a detection parameter as a function of the feed-forward signal (FF) and the error signal (ERR), and monitoring the detection parameter and setting a voice activity state depending on the detection parameter.

The improved concept will be described in more detail in the following with the aid of drawings. Elements having the same or similar function bear the same reference numerals throughout the drawings. Hence their description is not necessarily repeated in following drawings.

Figure 5:
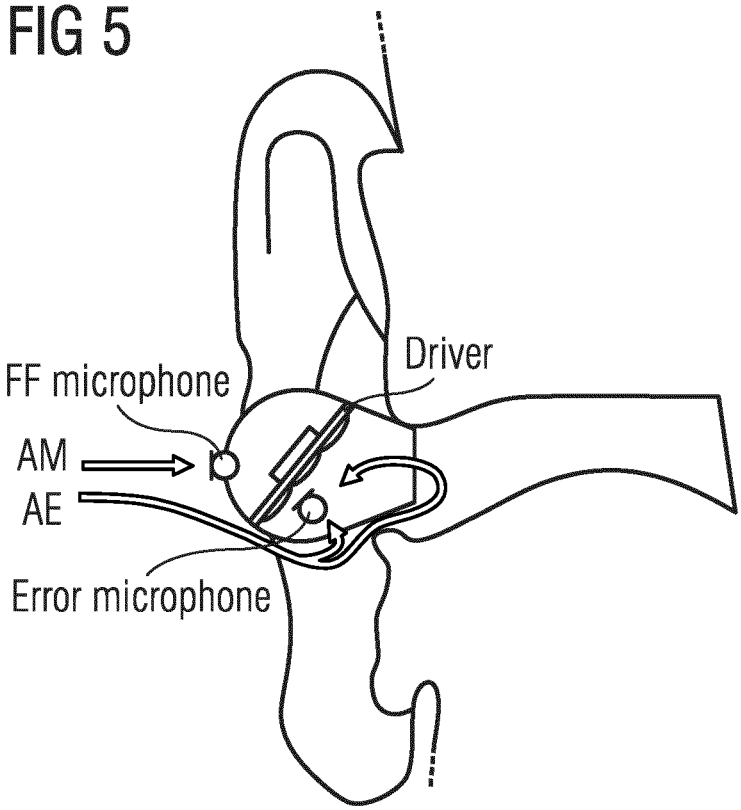
Figure 6:
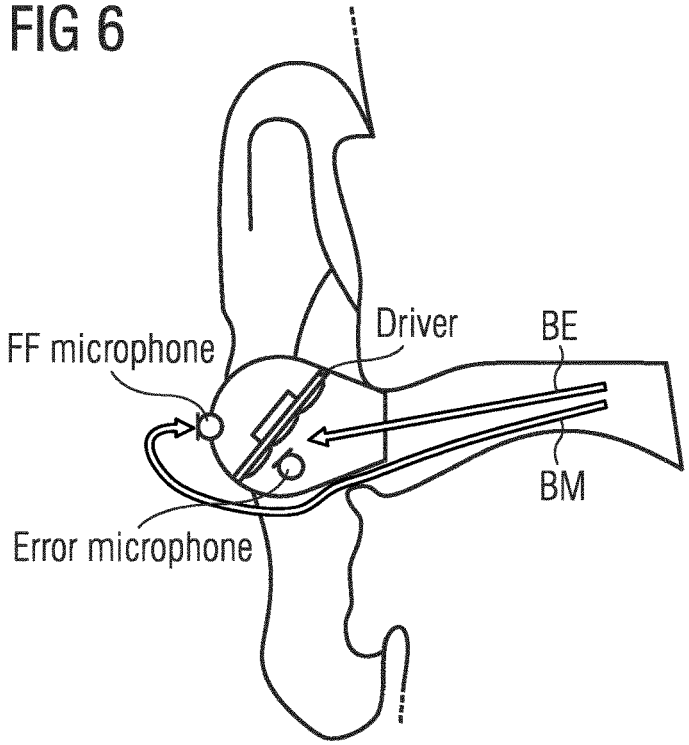
Figure 7:
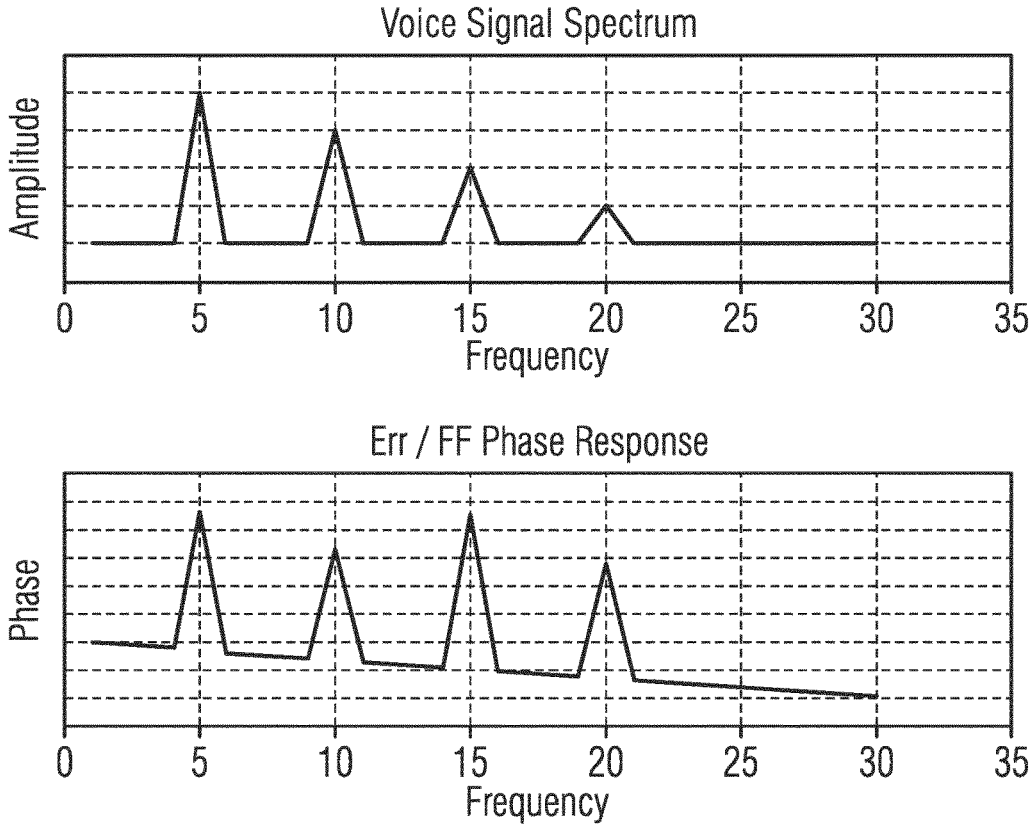
Figure 8:
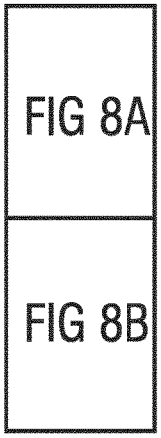
Figure 8A:
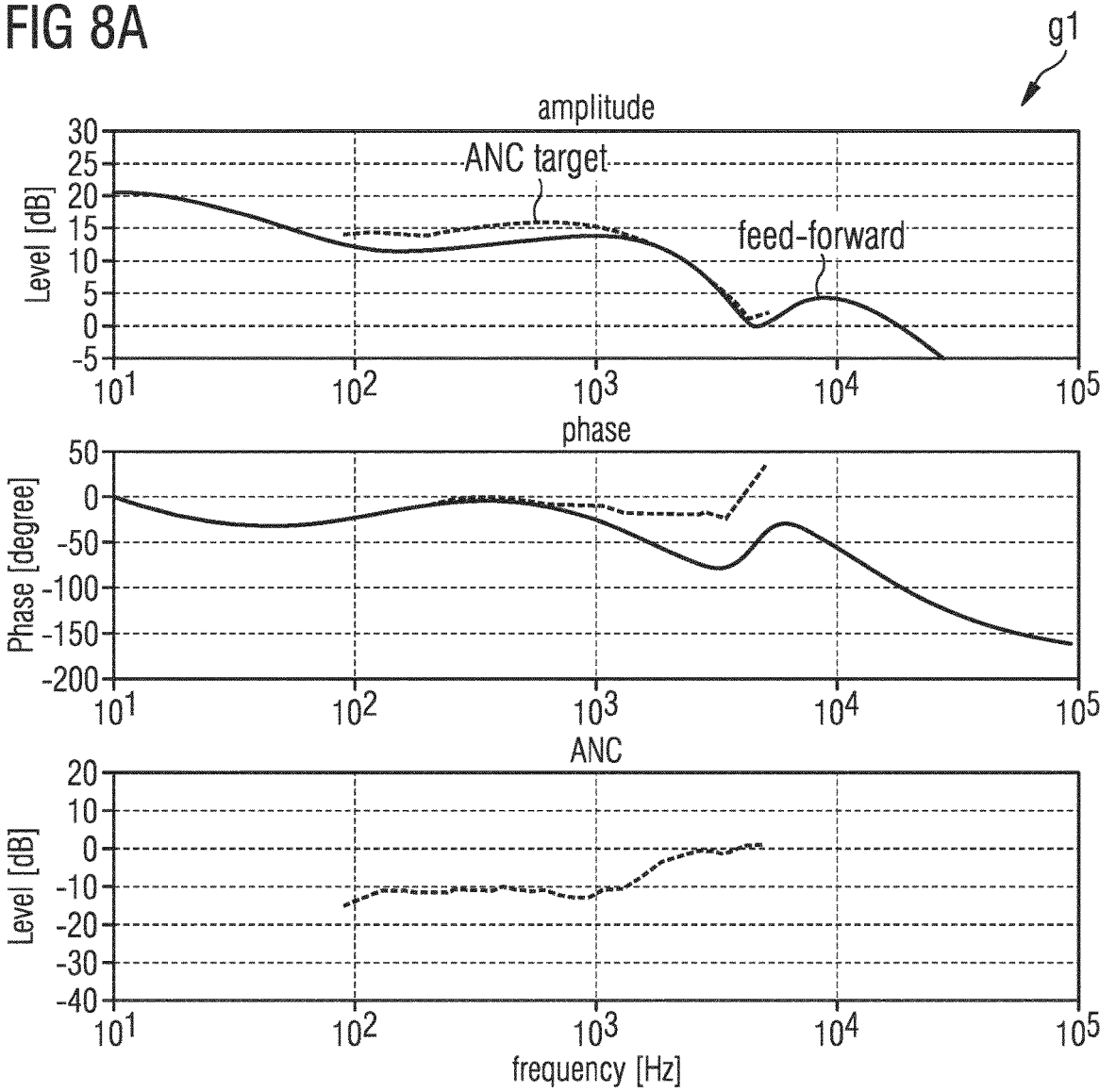
Figure 8B:
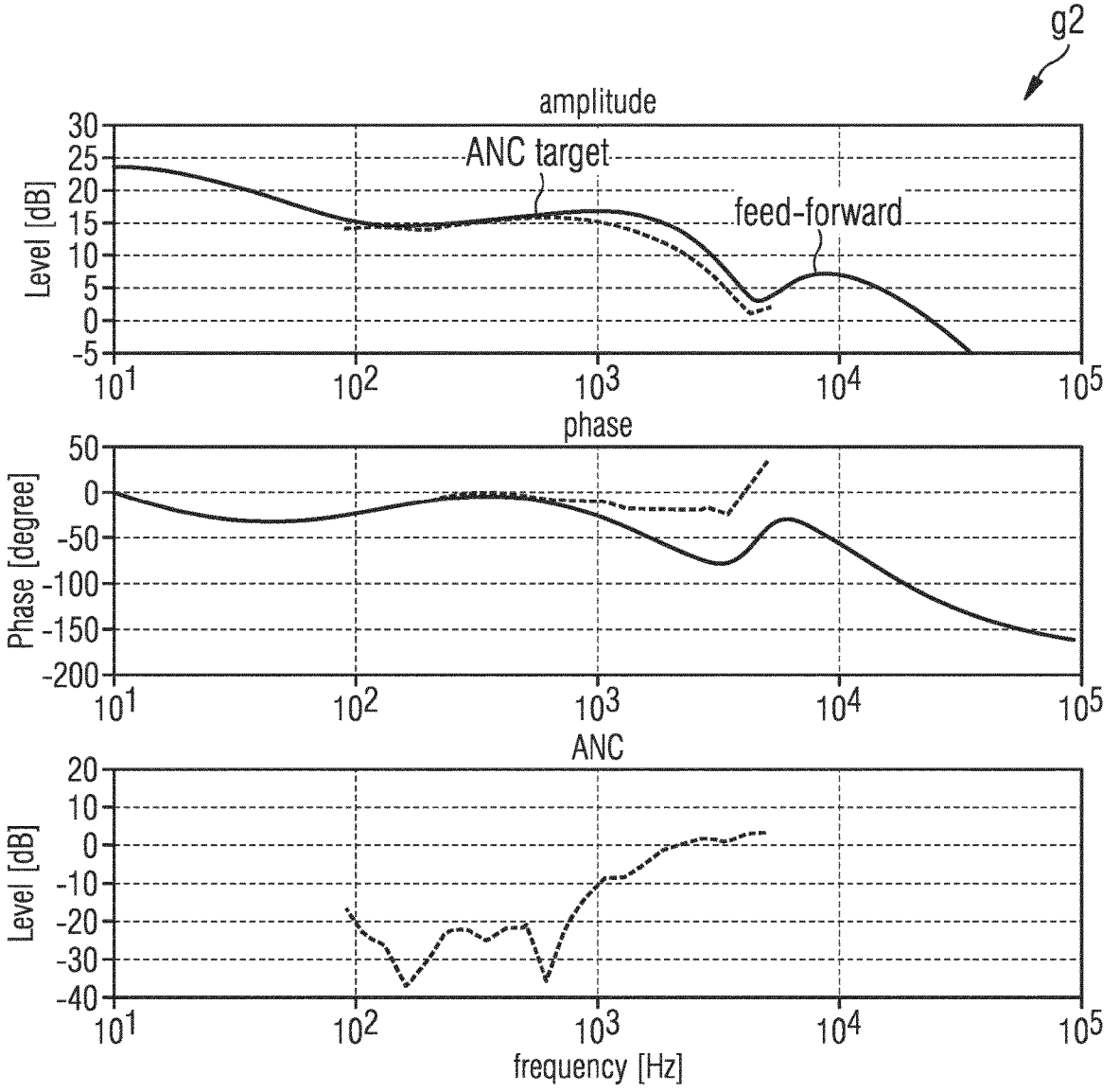
Figure 9:
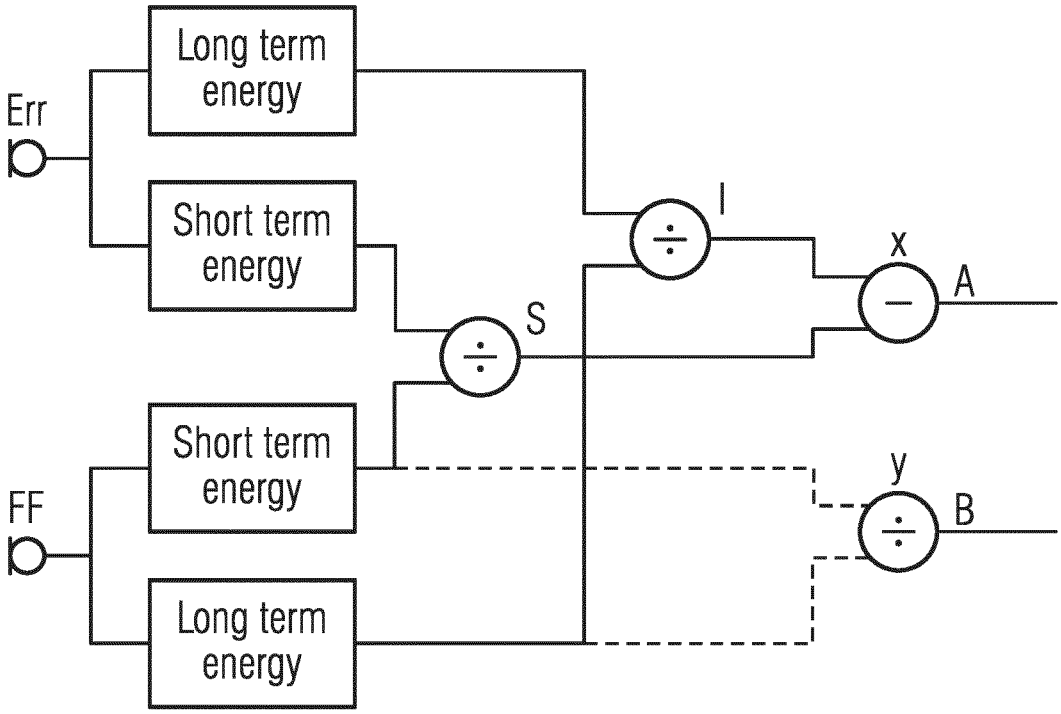
Figure 10:
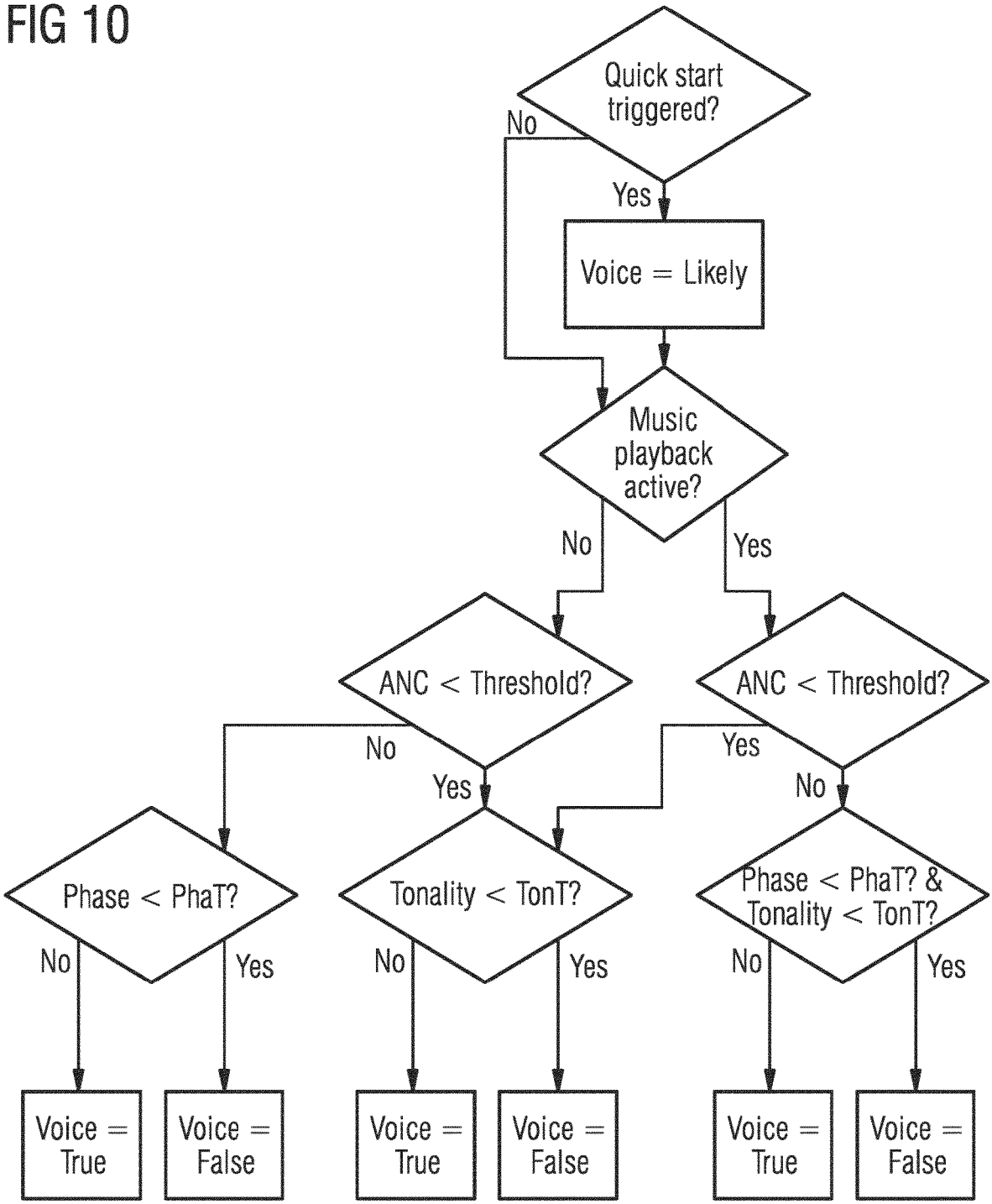

FIG. 5 shows ERR (AE) and FF (AM) signal pathways relative to ambient noise, FIG. 6 shows ERR (BE) and FF (BM) signal pathways for bone conducted voice sounds, FIG. 7 shows that a frequency vs. phase response of the ERR/FF transfer function, FIGS. 8A, 8B shows ANC performance graphs, FIG. 9 shows a mode of operation for fast detection of voice, and FIG. 10 shows a flowchart of possible modes of operation of the voice activity detector.

Figure 1:
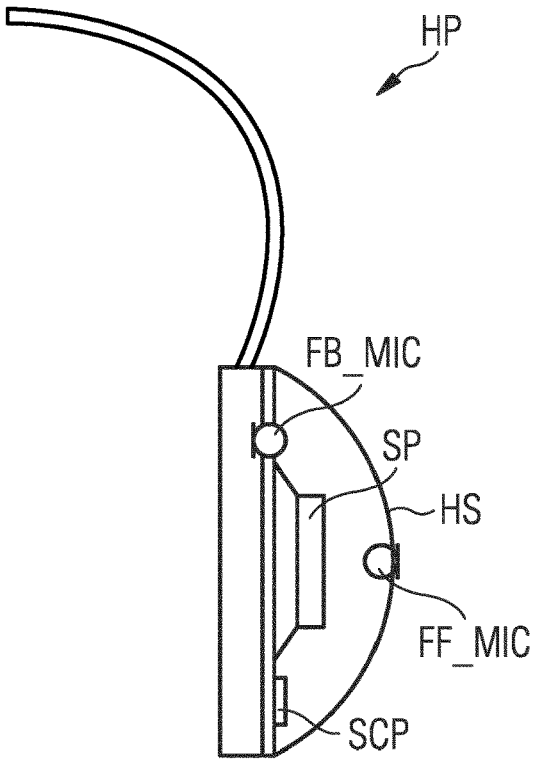
FIG. 1 shows a schematic view of a headphone.

FIG. 1 shows a schematic view of an ANC enabled playback device in form of a headphone HP that, in this example, is designed as an over-ear or circumaural headphone. Only a portion of the headphone HP is shown, corresponding to a single audio channel. However, extension to a stereo headphone will be apparent to the skilled reader. The headphone HP comprises a housing HS carrying a speaker SP, a feedback noise microphone or error microphone FB_MIC and an ambient noise microphone or feed-forward microphone FF_MIC. The error microphone FB_MIC is particularly directed or arranged such that it records both ambient noise and sound played over the speaker SP. Preferably, the error microphone FB_MIC is arranged in close proximity to the speaker, for example close to an edge of the speaker SP or to the speaker's membrane. The ambient noise/feed-forward microphone FF_MIC is particularly directed or arranged such that it mainly records ambient noise from outside the headphone HP. The error microphone FB_MIC may be used according to the improved concept to provide an error signal being used for voice activity detection.

In the embodiment of FIG. 1, a sound control processor SCP comprising an adaptive noise cancellation controller ANCC is located within the headphone HP for performing various kinds of signal processing operations, examples of which will be described within the disclosure below. The sound control processor SCP may also be placed outside the headphone HP, e.g. in an external device located in a mobile handset or phone or within a cable of the headphone HP.

Figure 2:
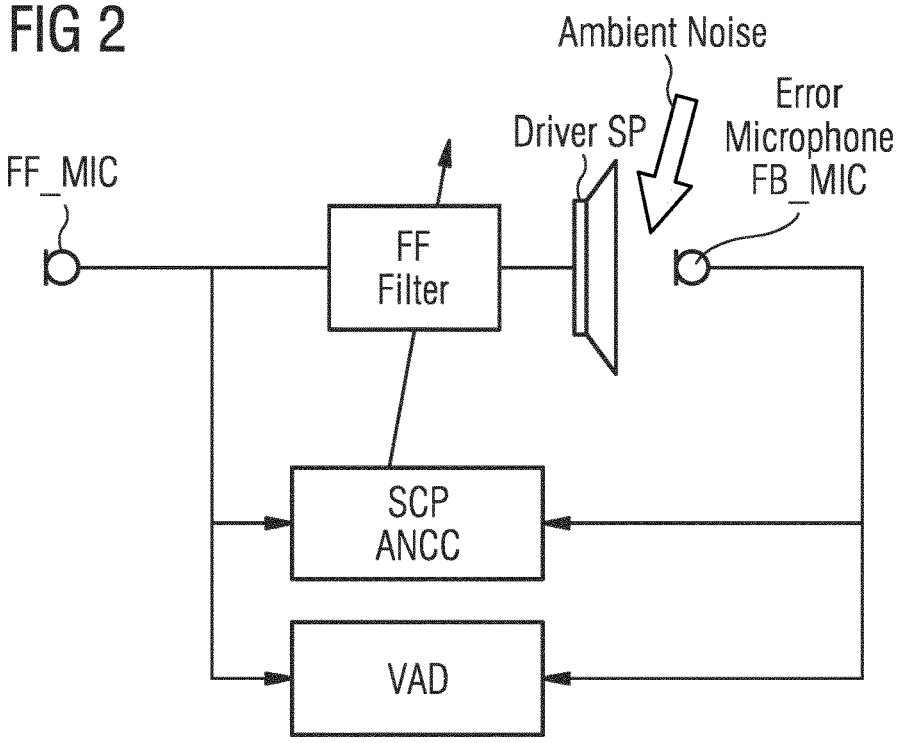
FIG. 2 shows a block diagram of a generic adaptive ANC system.

FIG. 2 shows a block diagram of a generic adaptive ANC system. The system comprises the error microphone FB_MIC and the feed-forward microphone FF_MIC, both providing their output signals to the adaptive noise cancellation controller ANCC of the sound control processor SCP. The noise signal recorded with the feed-forward microphone FF_MIC is further provided to a feed-forward filter for generating an anti-noise signal being output via the speaker SP. At the error microphone FB_MIC, the sound being output from the speaker SP combines with ambient noise and is recorded as an error signal ERR that includes the remaining portion of the ambient noise after ANC. This error signal ERR is used by the adaptive noise cancellation controller ANCC for adjusting a filter response of the feed-forward filter. A voice activity detector VAD is coupled to the adaptive noise cancellation controller ANCC, the feed-forward microphone FF_MIC and to the error microphone FB_MIC.

For example, one embodiment features an earphone EP with a driver, a front air volume acoustically coupled to the front face of the driver made up in part by the ear canal EC volume, a rear volume acoustically coupled to the rear face of the driver, a front vent with or without an acoustic resistor that couples the front volume to the ambient environment, and a rear vent with or without an acoustic resistor that couples the rear volume to the ambient environment. The front vent may be replaced by a vent that couples the front and rear volumes. The earphone EP may be worn with or without an acoustic leak between the front volume and the ear canal volume.

The error microphone FB_MIC may be placed such that it detects a signal from the front face of the driver and the ambient environment, and a feed-forward, FF, microphone FF_MIC is placed such that it detects ambient sound with a negligible part of the driver signal. The FF microphone is placed acoustically upstream of the error microphone FB_MIC with reference to ambient noise, and acoustically downstream of the error microphone with reference to bone conducted sound emitted from the ear canal walls when worn.

The earphone EP may feature FF, FB or FF and FB noise cancellation. The noise cancellation adapts at least in part to changes in acoustic leakage. A bone conducted voice signal affects both microphones signals such that the adaption finds a sub-optimal solution in the presence of voice. As such, the adaption must stop whenever the user is talking.

The FF microphone signal FF and error microphone signal ERR are both fed into a voice activity detector VAD which analyses the two signals to make a decision as to if the user is talking. The VAD returns three states: voice likely, voice false and voice true. These states are passed to the adaptive noise cancellation controller ANCC which makes a decision to stop adaption, restart adaption, or take no action.

The VAD runs three or four modes of operation, e.g. two slow and one fast. The fast process detects short term increases in level at the error microphone relative to the FF microphone. The fast process also detects short term increases in the FF microphone. If the short term increases in the error microphone relative to the FF microphone exceed a first threshold, FT1, and the short term increases in the FF microphone signal fall below a second threshold, FT2, the VAD sets the state: voice likely. The adaptive noise cancellation controller ANCC then pauses adaption in response.

One of two slow processes run depending on the ANC performance approximation, which is the ratio in the long term energy of the error microphone to the long term energy in the FF microphone. If the ANC performance is greater than (worse than) the ANC threshold, ANCT, as detection parameter, then the phase difference process, or first mode operation, which analyses the phase difference between the two microphones is run. If the ANC performance is less than (better than) ANCT, then a second mode of operation, the tonality process, which analyses the tonality of the error microphone is run. The phase difference process and the tonality process return a single metric which is tested against thresholds PDT for phase difference or TONT for tonality. The thresholds derive from an expected transfer function, for example.

The phase difference process may take a fast Fourier transform, FFT, of the error and FF microphone signals and calculate the phase difference between them. The error and FF signals may be down-sampled before the FFT is taken to maximize the FFT resolution for a given amount of processing.

The phase difference is calculated by dividing the two FFTs (ERR/FF) and taking the argument of the result. The phase difference smoothness of the result can be analyzed by a number of methods:

- Splitting the phase difference into several sections, computing a local variance for each section and then summing the result from each section to provide a single figure for the variance.
- Applying a linear regression to the data, and computing the squared deviation of each data point relative to the equivalent point in the resultant linear regression. Then summing the resultant deviations.
- Applying a regression to an S-curve based on Boltzmann's equation and computing the squared deviation at each data point to the resultant S-curve. Then summing the resultant deviations.
- Splitting the phase difference into several sections, computing a local linear regression and computing the squared deviation of each point relative to the equivalent linear regression point. Then summing the resultant deviations.
- High pass filtering the phase difference points to give a measure of smoothness, then calculating the RMS energy or equivalent measure of the resultant data.
- Calculating the rise and fall amplitudes of all peaks, averaging every adjacent rise and fall amplitudes to create a vector of peak amplitudes, discounting small peaks below a cut-off value as noise and summing the remaining peaks.

The tonality may be calculated in the frequency domain by taking the absolute value of the FFT of the error microphone FB_MIC signal ERR and calculating a measure of peakiness by using any of the metrics listed above for the phase difference variation.

The FFT for the phase difference or tonality calculation may be replaced by several DFTs calculated at predetermined frequencies.

The phase difference or tonality may be calculated using any of the methods above where the FFT is replaced by energy levels of signals filtered by the Goertzel algorithm.

The phase difference may be calculated in the time domain by filtering and subtracting the signals from the two microphones. If the phase difference is beyond a threshold, voice is assumed to be present.

The tonality may also be calculated in the time domain, for example by looking at zero crossings. Over a period of time, a linear regression of zero crossings vs. a sample index can be calculated. If the squared deviation relative to the resultant regression is below a threshold then the signal is said to be tonal. If the deviation is above said threshold then it is assumed that the zero crossings are random and the signal is not tonal. The input signal to this algorithm may be filtered to avoid the possibility of detecting tonality at frequencies beyond the voice band.

Averaging of the phase difference or tonality metrics, or replacing PDT and TONT with upper and lower thresholds, PDT1, PDT2, TONT1, TONT2 to apply a hysteresis for improved yield may be implemented.

If the resultant tonality level or phase difference smoothness is above a set threshold, then a voice true state is set. The ANCC stops adaption. If either parameter is below a set threshold, then a voice false state is set. The ANCC re-starts adaption.

If a wanted signal is played via the driver (i.e. music), then in the case that the ANC performance approximation is above ANCT, both the tonality level and phase difference smoothness metric must fall above their respective thresholds for the VAD to set a voice true state. This reduces false positives triggered by the music.

In the event that the earphones are a pair with a left set and a right set, only one VAD needs to run on one ear to set voice is likely, false or true states for both ears. In the case that one earphone is removed from one ear, and that is the ear which is running the VAD, the VAD will switch to the other ear. It will do this by reading the state of an off ear detection module, for example.

It may be that as the ANC performance approximation falls close to ANCT, the phase difference VAD metric will return more false positives than if ANC performance approximation is much higher (worse than) ANCT. This is because of the non-smooth phase difference resulting from the filter becoming close to the acoustics. In this case, the false positives will slow adaption speed but this can be acceptable because ANC performance is nearing an optimal null. If one earphone is removed from the ear, the VAD switches to the other ear, and then the earphone is re-inserted adaption may be slow for the ear that has just been re-inserted despite its ANC performance potentially being poor. To optimize adaption in this case, the VAD is set to the ear that is in an on ear state with the worst ANC performance approximation.

In order to know the ANC performance approximation for both sides, the fast VAD process must run both on left and right ears simultaneously.

It will be appreciated by those skilled in the art that there are many processes that can be used to detect peaks and troughs in the frequency and time domains. The improved concept is not limited to those shown here.

Figure 3:
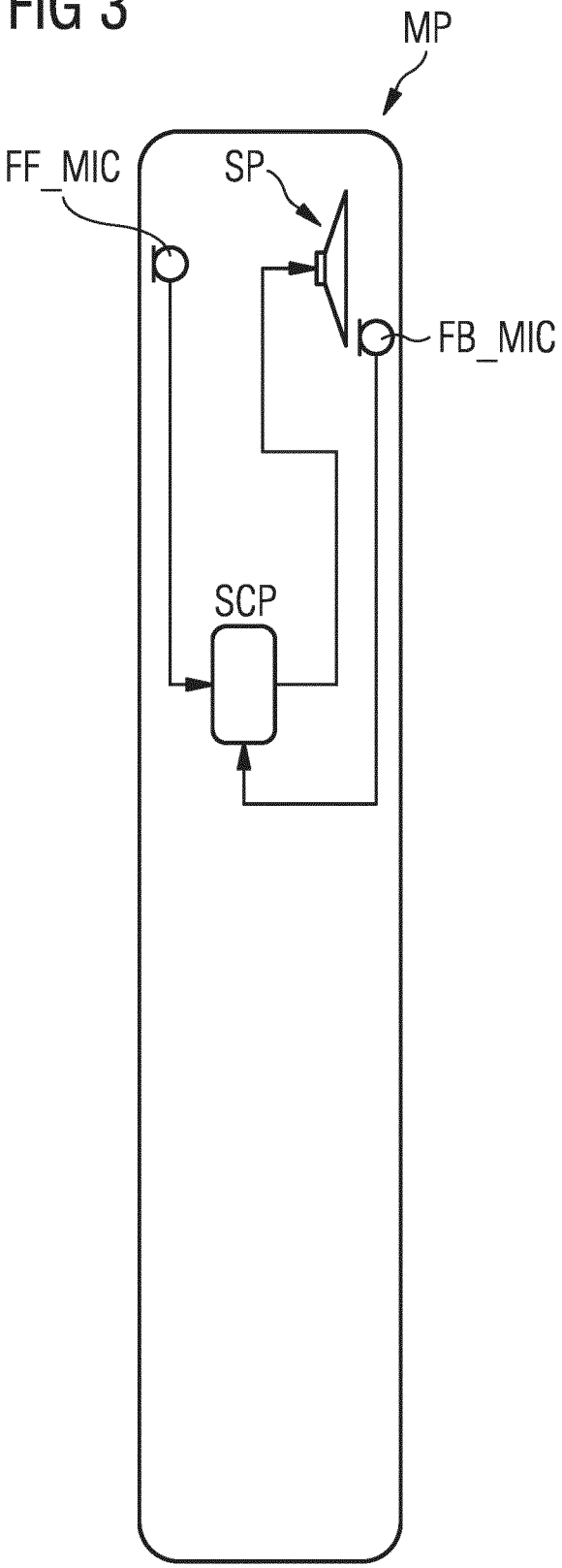
FIG. 3 shows an example representation of a "leaky" type mobile phone.

Referring now to FIG. 3, another example of a noise cancellation enabled audio system is presented. In this example implementation, the system is formed by a mobile device like a mobile phone MP that includes the playback device with speaker SP, feedback or error microphone FB_MIC, ambient noise or feed-forward microphone FF_MIC and an adaptive noise cancellation controller ANCC for performing inter alia ANC and/or other signal processing during operation.

In a further implementation, not shown, a headphone HP, e.g. like that shown in FIG. 1 or FIG. 5, can be connected to the mobile phone MP wherein signals from the microphones FB_MIC, FF_MIC are transmitted from the headphone to the mobile phone MP, for example the mobile phone's processor PROC for generating the audio signal to be played over the headphone's speaker. For example, depending on whether the headphone is connected to the mobile phone or not, ANC is performed with the internal components, i.e. speaker and microphones, of the mobile phone or with the speaker and microphones of the headphone, thereby using different sets of filter parameters in each case.

Figure 4:
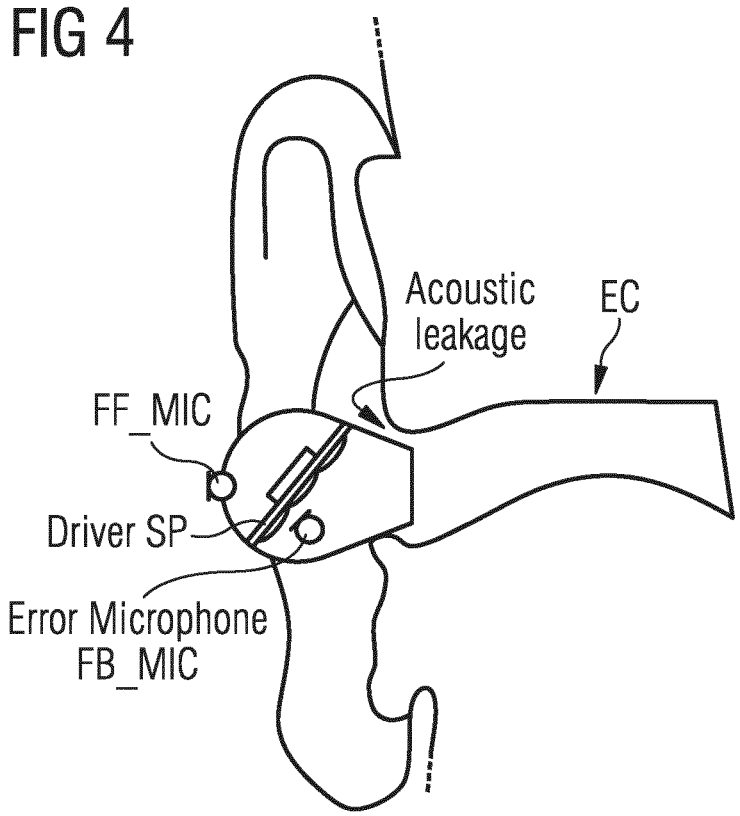
FIG. 4 shows an example representation of a "leaky" type earphone.

FIG. 4 shows an example representation of a "leaky" type earphone, i.e. an earphone featuring some leakage between the ambient environment and the ear canal EC. In particular, a sound path between the ambient environment and the ear canal EC exists, denoted as "acoustic leakage" in the drawing.

The proposed concept analyses signals at the error microphone FB_MIC and FF microphone FF_MIC to deduce whether voice is present in the ear canal EC. FF noise cancellation may be processed as described in introductory section, such that the signal at the FF microphone FF is the ambient noise at the FF microphone:

$$FF=AM$$

The signal ERR at the error microphone can be represented as:

$$ERR=AE-AM\cdot F\cdot DE$$

Dividing the two gives a set response:

$$\frac{ERR}{FF}=\frac{AE}{AM}-F.DE$$

All signals are complex, in the frequency domain, thus containing an amplitude and a phase component. It can be seen that the ratio of the two microphone signals ERR and FF is partly driven by the ratio of the acoustic transfer functions AE and AM.

Generally speaking, humans hear their own voice via three pathways. The first is the airborne pathway where the voice travels from the mouth to the ears and it is heard in the same way as ambient noise. The second is via bone conduction pathways that excite internal parts of the ear without becoming airborne. The third is via bone conduction pathways, through the ear canal walls and into the air, exciting the ear drum as with ambient sound. It is this third pathway that corrupts the error signal and causes issues with a headphone adapting noise cancellation parameters.

A voice activity detector can be used to detect voice from the person wearing the headphone, and not from the ambient noise source (i.e. detect the users voice, but ignore voice signals from third parties). The transfer function of the bone conducted sound varies from person to person and with how the headphones are worn (e.g. due to the occlusion effect). As such it may not possible to continue adaption whilst voice is present by taking advantage of a generic bone conduction transfer function. Therefore the voice activity detector is used to stop the adaption process when the bone conducted speech is present. If it stops adaption when speech from a third party is present, the adaption will stop unnecessarily, ultimately slowing adaption.

FIG. 5 shows ERR (AE) and FF (AM) signal pathways relative to ambient noise. ERR lags FF microphone. For ambient noise sources AE is delayed relative to AM due to acoustic propagation delays.

FIG. 6 shows ERR (BE) and FF (BM) signal pathways for bone conducted voice sounds. ERR leads FF microphone. If bone conducted voice is transmitted via the ear canal EC, then the direction of the voice signal is opposite to that of the ambient noise and the FF microphone now lags the error microphone resulting in a different phase response. The bone conducted parts of voice are generally tonal and as such the overall phase response to a combined signal of ambient noise and voice is quite different depending on frequency. This results in a frequency vs. phase difference between the two microphones that is littered with peaks and troughs.

FIG. 7 shows that the frequency vs. phase response of the ERR/FF transfer function with noise cancellation and voice exhibiting peaks based on bone conducted voice signals which typically contain a fundamental and harmonics. This frequency dependent deviation in phase difference is used to detect if voice is present for the first mode of operation.

It is worth noting that part of the voice signal that is airborne behaves like ambient noise and does not cause a different phase response from that with ambient noise so this does not pose a problem. It is also worth noting that the transfer function of bone conducted voice propagating out of the ear varies substantially from person to person, so any metric used to detect peaks in this response needs to simply detect "peakiness" and not a specific transfer function. Furthermore the phase response without voice present will differ depending on leakage and ANC filter properties (FB and FF).

Not all voice signals show significant harmonics, so detecting a harmonic relationship in the peaks may not produce a reliable approach.

Detecting these peaks has the advantage that it only detects the headphone users bone conducted voice, and not airborne voice pathways, or voice from a third party. In the case of an adaptive noise cancelling headphone where voice can interfere with adaption, the voice activity detector must pause this process. Detecting only user voice and not third party voice signals ensures the adaption is stopped less often.

FIGS. 8A and 8B show ANC performance graphs, e.g. feedforward target and ANC performance. In an ANC headphone FF system, as the ANC tends towards being good (that is as the FF filter has a close match with the acoustics (feedforward target)), the ANC performance can show as peaks and troughs. The graphs g1 in FIG. 8A show an ANC process with worse ANC performance than the graphs g2 in FIG. 8B below.

For good ANC (graphs g2 in FIG. 8B), the filter should match the amplitude and phase of the acoustics very closely. Small frequency dependent amplitude and phase variations in acoustics response mean that the filter intersects the acoustics response in several places resulting in very different ANC in neighboring frequency bands.

This means the error signal ERR will be peaky compared to the FF signal and will falsely report voice is present when ANC approaches good performance. As such, the first mode of operation would falsely detect voice and stop adaption when the solution is producing sub-optimal ANC. Because of this, the VAD switches to the second mode of operation when the detection parameter, in this case the ANC performance falls below a threshold. The ANC performance is approximated by the ratio of the error microphone energy to the FF microphone energy. In the case that music is played from the device, a process runs to remove the music from the error microphone signal. In the case that this removal of the music is not effective enough, the ANC approximation is calculated by:

$$ANC_{approx} = \frac{ERR - MUS}{FF}.$$

where all values represent energy levels, ERR is the signal at the error microphone, FF is the signal at the FF microphone and MUS is the sound signal or music signal.

The second mode of operation analyses the signals at the error microphone only. In this instance, it monitors the error signal ERR and triggers a voice active state if tonality is detected. This method of detecting voice no longer triggers only for the user's voice, but will also falsely trigger if the ambient noise is particularly tonal. This means that for highly tonal ambient noise sources adaption cannot go beyond the ANC threshold. ANC threshold is typically about 20 dB, though so this is deemed acceptable.

FIG. 9 shows a mode of operation for fast detection of voice. The previous two processes, herein referred to as "slow" processes may run in the frequency domain or be subject to delays from time averaging processes and as such may not be able to stop adaption quickly enough. A third process, herein referred to as a "fast" process runs in the time domain to detect sudden increases in energy at the error microphone relative to the FF microphone. That is, it detects sudden decreases in the ANC performance approximation which occur with voice.

The fast process is calculated as shown in FIG. 9. The ratio of energy between the two microphones (ERR/FF) is calculated. This ANC performance approximation energy is calculated over a short time period, and a long time period. The difference of the short term energy to the long term energy (A) will therefore go positive if the ANC performance is suddenly reduced, which typically the case when voice is present.

If the onset of voice is gradual, then the slow processes are deemed fast enough to react appropriately.

In adaptive ANC headphones, it can be that a sudden decrease in ANC performance is also a result of quickly changing the acoustic load around the headphone, for example pushing an earphone into the ear suddenly. Before the system has time to fully adapt, the error energy will have increased relative to the FF signal which could trigger the fast process. In this case, the action may be to pause adaption for fear of voice being present, delaying the adaption of the earphone. To correct for this, the short term energy to long term energy ratio of the FF or noise signal is also monitored (B). This goes above 1 if the ambient noise has suddenly increased. This always happens when voice is present due to the airborne voice path.

Therefore, applying simple logic to this arrangement can set a voice is likely state:

if A>Threshold_1 & B>Threshold_2:
voice=likely

This may be useful as a highly aggressive VAD for adaptive ANC as it can quickly pause adaptive processes on the assumption that voice is present, and then rely on the slow, more accurate metrics to re-enable adaption.

It will be obvious to the skilled reader that the subtraction and division stages x and y can either be a subtraction or a division and yield comparable functionality.

FIG. 10 shows a flowchart of possible modes of operation of the voice activity detector. The voice activity detector may run with three or four modes:

1. The fast process sets a voice likely state and waits for a result from the slow processes.
2. If ANC performance is above the ANC threshold, the phase difference between the two microphones is considered
3. If ANC performance is below the ANC threshold, the error microphone tonality is considered.

The VAD will primarily operate in mode 1 and 2, and as such offers a VAD that is sensitive to bone conducted voice. In a fourth mode, when music is active, the VAD may either enter the second mode or a combination of both first and second mode. In the case that music is playing, the phase detection metric may return false positives unacceptably often. In this case, the logic is changed such that both the tonality and the phase difference are monitored for the voice condition. These are both highly likely to be triggered with voice, but it is far less likely that both are triggered with the music.

There are several methods to detect peaks and tonality for modes 2 and 3, with differing advantages. Some examples are discussed here, but alternative peak detection and tonality methods not disclosed here may be used.

In the embodiments discussed above an ANC performance parameter has been used. This parameter may be defined as ratio of ERR and FF, for example. However, other definitions are possible so that in general a detection parameter may be considered. As an example, one alternative way to monitor the ANC performance (in an adaptive system) could be to look the gradient of the adapting parameters. When adaption has been successful, the adapting parameters change more slowly and therefore the gradient of these parameters flattens out.

The invention claimed is:

1. A signal processing method of voice activity detection for an ear mountable playback device comprising a speaker, an error microphone predominantly sensing sound being output from the speaker and also sensing ambient sound, and a feed-forward microphone predominantly sensing ambient sound, the method comprising the steps of:

using a voice activity detector:

recording a feed-forward signal from the feed-forward microphone, recording an error signal from the error microphone, determining at least one detection parameter as a function of the feed-forward signal and the error signal, and monitoring the at least one detection parameter and setting a voice activity state depending on the at least one detection parameter; and further, using an adaptive noise cancellation controller coupled to the feed-forward microphone and to the error microphone:

performing noise cancellation processing depending on the feed-forward signal and/or the error signal, and by using a filter coupled to the feed-forward microphone and to the speaker, having a filter transfer function determined by the noise cancellation processing, wherein the detection parameter:

is based on a ratio of the feed-forward signal and the error signal, the method comprising the further steps, using the voice activity detector:

monitoring a sound signal played from the device, and determining one of the following voice activity states: false, true, or likely, the voice activity state equals true indicates voice detected, and the voice activity state equals false indicates voice not detected, the method comprising the further steps, using the voice activity detector:

controlling the adaptive noise cancellation controller depending on the voice activity state, the method being characterized by further comprising the steps of:

using the voice activity detector entering either a first mode of operation or a second mode of operation, respectively, when the detection parameter is larger than a first threshold or smaller than the first threshold, in the first mode of operation, analyzing a phase difference between the feed-forward signal and the error signal and setting the voice activity state depending on the analyzed phase difference, in the second mode of operation:

analyzing a level of tonality of the error signal and setting the voice activity state depending on the analyzed level of tonality, the method comprising the further steps, using the voice activity detector:

determining whether or not the sound signal is active, and if the sound signal is active entering in a fourth mode of operation, wherein:

using the voice activity detector, the second mode operation is entered if the detection parameter is smaller than the first threshold, and if the detection parameter exceeds the first threshold, a combined first and second mode of operation is entered, the combined first and second mode of operation comprising, using the voice activity detector, setting the voice activity state depending on both the analyzed phase difference and level of tonality.

2. An audio system for an ear mountable playback device comprising:

a speaker, an error microphone sensing sound being output from the speaker and ambient sound and a feed-forward microphone predominantly sensing ambient sound, wherein the audio system comprises a voice activity detector configured to:

recording a feed-forward signal from the feed-forward microphone, recording an error signal from the error microphone, determining at least one detection parameter as a function of the feed-forward signal and the error signal, and monitoring the at least one detection parameter and setting a voice activity state depending on the at least one detection parameter, an adaptive noise cancellation controller coupled to the feed-forward microphone and to the error microphone, the adaptive noise cancellation controller being configured to perform noise cancellation processing depending on the feed-forward signal and/or the error signal, a filter coupled to the feed-forward microphone and to the speaker, having a filter transfer function determined by the noise cancellation processing, wherein the at least one detection parameter:

is based on a ratio of the feed-forward signal and the error signal, is a phase difference between the error signal and the feed-forward signal, or is further based on a sound signal, and wherein:

a voice activity detector process determines one of the following voice activity states: false, true, or likely, the voice activity state equals true indicates voice detected, and the voice activity state equals false indicates voice not detected, and/or the voice activity detector controls the adaptive noise cancellation controller depending on the voice activity state, and wherein the voice activity detector, in a first mode of operation:

analyses a phase difference between the feed-forward signal and the error signal and sets the voice activity state depending on the analyzed phase difference and/or the first mode of operation is entered when the detection parameter is larger than a first threshold and wherein the voice activity detector, in a second mode of operation:

analyzes a level of tonality of the error signal and sets the voice activity state depending on the analyzed level of tonality and/or the second mode of operation is entered when the detection parameter is smaller than the first threshold and wherein the voice activity detector, in a fourth mode of operation the voice activity detector:

determines whether or not the sound signal is active, if no sound signal is active enters the first or second mode of operation, if the sound signal is active, enters the second mode operation if the detection parameter is smaller than the first threshold, and if the sound signal is active, and if the detection parameter exceeds the first threshold, enters a combined first and second mode of operation.

3. The audio system according to claim 2, wherein the noise cancellation processing includes feed-forward, or feed-backward, or both feed-forward and feed-backward noise cancellation processing.

4. The audio system according to claim 2, wherein the control of the adaptive noise cancellation controller comprises:

suspending the adaption of a noise cancelling signal in case the voice activity state is set to true and/or likely, and continuing the adaption of a noise cancelling signal in case the voice activity state is set to false.

5. The audio system according to claim 2, wherein the analyzed phase difference is compared to an expected phase difference, and the voice activity state is set to false when the analyzed phase difference is smaller than the expected phase difference and set to true else.

6. The audio system according to claim 2, wherein the analyzed level of tonality is compared to an expected level of tonality, and the voice activity state is set to false when the analyzed tonality is smaller than the expected tonality and set to true else.

7. The audio system according to claim 2, wherein the voice activity detector, in a third mode of operation, which may run independently of the first mode and the second mode:

monitors the detection parameter for a first period of time, denoted short term parameter, and for a second period of time, denoted long term parameter, wherein the first period is shorter in time than the second period, combines the short parameter and the long term parameter to yield a combined detection parameter, and sets the voice activity state depending on the combined detection parameter.

8. The audio system according to claim 7, wherein in the third mode of operation:

the short term parameter and long term parameter are equivalent to energy levels, and voice activity state is set to likely when a change in relative energy levels exceeds a second threshold.

9. The audio system according to claim 2, wherein the voice activity detector, in the combined first and second mode of operation:

analyses a level of tonality of the error signal and analyses a phase difference between the feed-forward signal and the error signal and sets the voice activity state depending on both the analyzed phase difference and analyzed level of tonality, and/or in the first and second mode of operation:

the analyzed level of tonality is compared to an expected level of tonality and the analyzed phase difference is compared to an expected phase difference, the voice activity state is set to false when the analyzed level of tonality is smaller than the expected level of tonality and, further, the analyzed phase difference is smaller than the expected phase difference, and the voice activity state is set to true when either the analyzed level of tonality exceeds the expected level of tonality and, further, the analyzed phase difference exceeds the expected phase difference.

* * * * *